US012030738B2

(12) United States Patent
Tatematsu et al.

(10) Patent No.: US 12,030,738 B2
(45) Date of Patent: Jul. 9, 2024

(54) IMAGE FORMING APPARATUS

(71) Applicant: Brother Kogyo Kabushiki Kaisha, Nagoya (JP)

(72) Inventors: Yuya Tatematsu, Nagoya (JP); Masatomo Yamaguchi, Inazawa (JP); Satoshi Miyase, Nagoya (JP); Kengo Noda, Inazawa (JP); Gakuro Kanazawa, Toyokawa (JP); Nao Morimoto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 82 days.

(21) Appl. No.: 17/563,733

(22) Filed: Dec. 28, 2021

(65) Prior Publication Data

US 2022/0204290 A1 Jun. 30, 2022

(30) Foreign Application Priority Data

Dec. 29, 2020 (JP) ..... 2020-219780

(51) Int. Cl.
*B65H 3/06* (2006.01)
*B65H 1/08* (2006.01)
(Continued)

(52) U.S. Cl.
CPC ..... *B65H 3/0684* (2013.01); *B65H 1/08* (2013.01); *B65H 16/10* (2013.01); *B65H 35/008* (2013.01);
(Continued)

(58) Field of Classification Search
CPC ..... B65H 2301/23; B65H 2301/43151; B65H 2301/4318; B65H 39/14; B65H 39/105; B65H 18/106
See application file for complete search history.

(56) References Cited

U.S. PATENT DOCUMENTS 5,072,306 A 12/1991 Matsumoto et al.
10,359,724 B2 7/2019 Yasuda et al.
(Continued)

FOREIGN PATENT DOCUMENTS

JP H02-264556 A 10/1990
JP H08-169580 A 7/1996
(Continued)

*Primary Examiner* — Howard J Sanders
(74) *Attorney, Agent, or Firm* — Banner & Witcoff, Ltd.

(57) ABSTRACT

An image forming apparatus includes: a housing; a feed tray insertable into and removable from the housing and accommodating a sheet-shaped medium; a feed roller feeding the sheet-shaped medium; an image forming device; and a movement mechanism. The feed tray includes: a first accommodation portion accommodating a roll body, a first sheet-shaped medium being rolled in a roll shape as the roll body; and a second accommodation portion accommodating a second sheet-shaped medium which is shorter than the first sheet-shaped medium. The movement mechanism moves to a first position where the feed roller contacts the first sheet-shaped medium unrolled from the roll body accommodated in the first accommodation portion and a second position where the feed roller contacts the second sheet-shaped medium accommodated in the second accommodation portion.

23 Claims, 10 Drawing Sheets

(51) Int. Cl.
*B65H 16/10* (2006.01)
*B65H 35/00* (2006.01)

(52) U.S. Cl.
CPC .. *B65H 2404/121* (2013.01); *B65H 2405/353* (2013.01); *B65H 2801/06* (2013.01)

(56) References Cited

U.S. PATENT DOCUMENTS

| | | | | |
|---|---|---|---|---|
| 2017/0102657 | A1 | 4/2017 | Yasuda et al. | |
| 2021/0300706 | A1* | 9/2021 | Tsujimura | B65H 35/006 |
| 2022/0169051 | A1* | 6/2022 | Yamaguchi | B41J 15/042 |
| 2022/0203710 | A1* | 6/2022 | Yamaguchi | B41J 11/0045 |
| 2022/0203714 | A1* | 6/2022 | Sato | B41J 13/0018 |
| 2022/0204297 | A1* | 6/2022 | Noda | B65H 3/0684 |

FOREIGN PATENT DOCUMENTS

| | | | | |
|---|---|---|---|---|
| JP | 2003-029480 | A | | 1/2003 |
| JP | 2007-269462 | A | | 10/2007 |
| JP | 2016037355 | A | * | 3/2016 |
| JP | 2017-071492 | A | | 4/2017 |

* cited by examiner

IMAGE FORMING APPARATUS

CROSS-REFERENCE TO RELATED APPLICATIONS

This application is based on and claims priority under 35 USC 119 from Japanese Patent Application No. 2020-219780 filed on Dec. 29, 2020, the contents of which are incorporated herein by reference.

TECHNICAL FIELD

The present disclosure relates to an image forming apparatus including a feed tray configured to accommodate both a roll body and a sheet-shaped medium.

BACKGROUND

A related-art image forming apparatus proposes accommodating both a roll body around which sheet-shaped paper is rolled in a roll shape and cut paper. For example, a related-art facsimile (an image forming apparatus) includes a paper feed cassette (a feed tray) in which a placing portion for a roll body and a placing portion for cut paper are formed.

SUMMARY

An image forming apparatus according to an illustrative aspect of the present disclosure includes: a housing; a feed tray insertable into and removable from the housing, the feed tray being configured to accommodate a sheet-shaped medium; a feed roller configured to feed the sheet-shaped medium from the feed tray toward a conveyance path; an image forming device configured to form an image on the sheet-shaped medium in the conveyance path; and a movement mechanism. The feed tray may include: a first accommodation portion configured to accommodate a roll body, a first sheet-shaped medium being rolled in a roll shape as the roll body; and a second accommodation portion configured to accommodate a plurality of second sheet-shaped media in a stacked state, the second sheet-shaped medium being shorter than the first sheet-shaped medium. The movement mechanism may be configured to move to a first position and a second position. In a case the movement mechanism is in the first position, the feed roller may contact the first sheet-shaped medium unrolled from the roll body accommodated in the first accommodation portion. In a case the movement mechanism is in the second position, the feed roller may contact the second sheet-shaped medium accommodated in the second accommodation portion.

According to the present disclosure, a first sheet-shaped medium unrolled from a roll body accommodated in a first accommodation portion or a second sheet-shaped medium accommodated in a second accommodation portion can be selectively conveyed by a common feed roller. Accordingly, an image forming apparatus including a feed tray accommodating both the roll body and the second sheet-shaped medium prevents an increase in size of the device.

BRIEF DESCRIPTION OF DRAWINGS

Illustrative embodiments of the disclosure will be described in detail based on the following figures, wherein.

DETAILED DESCRIPTION

In the above-described related-art image forming apparatus, a roller for feeding roll paper unrolled from the roll body and a roller for feeding the cut paper are separately provided from the paper feed cassette. In such an image forming apparatus, it is required to provide a space for disposing the respective rollers for the roll paper and the cut paper inside the device, which causes an increase in size of the device.

Therefore, illustrative aspects of the present disclosure provide an image forming apparatus that prevents an increase in size of the image forming apparatus including a feed tray accommodating both a roll body and a sheet-shaped medium.

First Illustrative Embodiment

A printer 100 (an image forming apparatus of the present disclosure) according to a first illustrative embodiment of the present disclosure will be described below with reference to FIGS. 1 to 7. An up and down direction, a left and right direction, and a front and rear direction illustrated in FIG. 1 are defined as an up and down direction, a left and right direction, and a front and rear direction of the printer 100.

Overall Configuration of Printer 100

Figure 1:
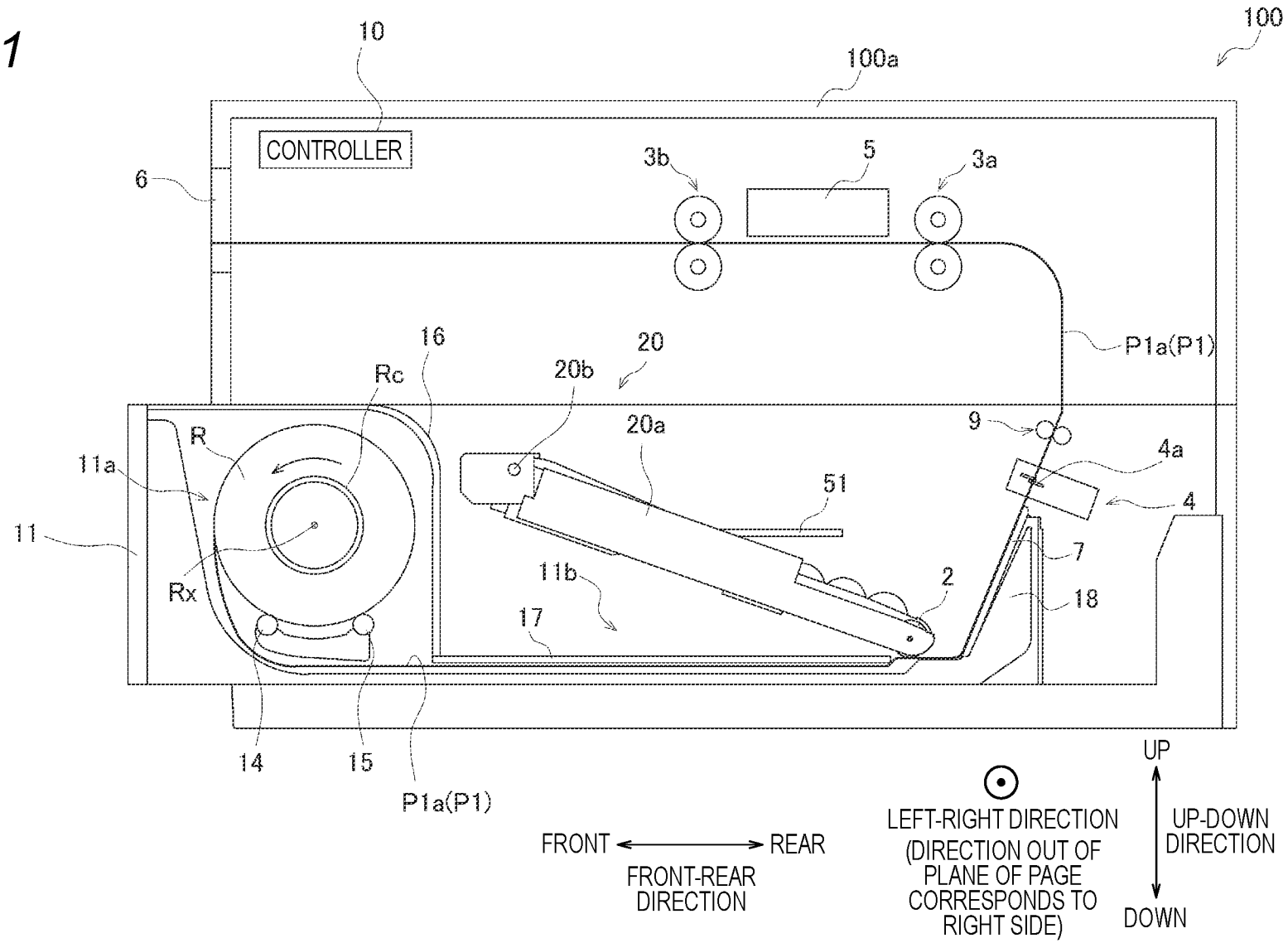
FIG. 1 is a schematic configuration diagram of a printer according to a first illustrative embodiment of the present disclosure.

As illustrated in FIG. 1, the printer 100 includes a housing 100*a*, a feed tray 11, a feed roller 2, a pair of conveyance rollers 3*a*, a pair of paper discharge rollers 3*b*, a cutter mechanism 4, a head 5 (an image forming portion of the present disclosure), a paper discharge tray 6, a guide 7, a pair of intermediate rollers 9, and a controller 10. The feed tray 11 can be inserted into and removed from a lower part of the housing 100*a*. The output tray 6 forms a side wall on a front side of an upper part of the housing 100*a*, and can be opened and closed with respect to the housing 100*a*.

The feed tray 11 can be inserted into and removed from the housing 100*a* in the front and rear direction. The feed tray 11 includes a first accommodation portion 11*a* and a second accommodation portion 11*b*. The first accommodation portion 11*a* may accommodate a roll body R. A long paper P1 (a long sheet-shaped medium or a first sheet-shaped medium of the present disclosure) may be rolled in a roll shape around the roll body R. The second accommodation portion 11*b* may accommodate a plurality of sheets of cut paper P2 (a cut medium or a second sheet-shaped medium of the present disclosure, refer to FIG. 2), which is shorter than the long paper P1, in a stacked state. A convex portion 18 extending upward is formed at a rear end portion of the feed tray 11, that is, at an upstream end portion in a direction of removing the feed tray 11 from the housing 100*a*. The convex portion 18 is a member for preventing the cut paper P2 accommodated in the second accommodation portion 11*b* from falling off when the feed tray 11 is inserted into and removed from the housing 100*a*.

The first accommodation portion 11*a* includes a cylindrical core member Rc, two rollers 14 and 15, and a roll cover 16. In the roll body R is, the long paper P1 is rolled around an outer peripheral surface of the cylindrical core member Rc in a roll shape. The roll body R is disposed so that an axial direction (a direction perpendicular to a paper surface in FIG. 1) along a rotating shaft Rx thereof (a central axis of the core member Rc) is parallel to the left and right direction. The axial direction of the rotating shaft Rx also corresponds to a width direction of the long paper P1 and the cut paper P2.

The two rollers 14 and 15 extend long along the left and right direction, and are formed to be slightly longer than a width of the roll body R. The roller 15 is disposed behind the roller 14. Rotating shafts of the rollers 14 and 15 are parallel to the rotating shaft Rx. The two rollers 14 and 15 support the roll body R from below in a state of contacting an outer peripheral surface of a lower portion of the roll body R.

When the long paper P1 is unrolled from the roll body R, the two rollers 14 and 15 rotate according to the roll body R that rotates counterclockwise (a solid arrow in FIG. 1). In the illustrative embodiment, the long paper P1 unrolled from the roll body R accommodated in the first accommodation portion 11*a* is referred to as roll paper P1*a* (a roll medium of the present disclosure). The roll paper P1*a* unrolled from the roll body R accommodated in the first accommodation portion 11*a* is fed to the feed roller 2 through a path below a bottom surface 17 (described later) of the second accommodation portion 11*b*. The roll paper P1*a* is fed by the feed roller 2 toward a conveyance path, and is fed to the paper discharge tray 6 via the pair of intermediate rollers 9, the pair of conveyance rollers 3*a*, the head 5, and the pair of paper discharge rollers 3*b*. The conveyance path of the roll paper P1*a* is defined by the feed roller 2, the pair of intermediate rollers 9, the pair of conveyance rollers 3*a*, and the pair of paper discharge rollers 3*b*.

The roll cover 16 is a member that covers the roll body R accommodated in the first accommodation portion 11*a*. The roll cover 16 extends along the left and right direction and is formed to be longer than widths of the rollers 14 and 15. The roll cover 16 is disposed to be close to an outer peripheral surface of the roll body R having the maximum size that can be accommodated in the first accommodation portion 11*a*. Accordingly, even though the roll of the roll body R is loosened and an outer diameter of the roll body R increases, the outer peripheral surface of the roll body R contacts an inner surface of the roll cover 16 such that an increase in the outer diameter of the roll body R can be prevented.

The second accommodation portion 11*b* is located behind the first accommodation portion 11*a* and includes the bottom surface 17 that supports the cut paper P2 from below. The bottom surface 17 extends long along the left and right direction, and is formed to be slightly longer than a width of the cut paper P2. The cut paper P2 accommodated in the second accommodation portion 11*b* is fed by the feed roller 2 toward the conveyance path, and is fed to the paper discharge tray 6 through the pair of intermediate rollers 9, the pair of conveyance rollers 3*a*, the head 5, and the pair of paper discharge rollers 3*b*. The conveyance path of the cut paper P2 is defined by the feed roller 2, the pair of intermediate rollers 9, the pair of conveyance rollers 3*a*, and the pair of paper discharge rollers 3*b*.

A notch is formed at a rear end portion of the bottom surface 17 of the second accommodation portion 11*b* and at a central portion of the rear end portion thereof in the left and right direction. When the roll paper P1*a* is printed, as described above, the roll paper P1*a* unrolled from the roll body R is fed to the feed roller 2 through the path below the bottom surface 17 of the second accommodation portion 11*b*. Next, the roll paper P1*a* is fed toward the conveyance path by contacting the feed roller 2 from a notched portion of the bottom surface 17 of the second accommodation portion 11*b* in a state where the cut paper P2 is not accommodated.

The second accommodation portion 11*b* is formed with a mark 51 indicating the maximum height position when the maximum number of sheets of cut paper P2 is accommodated therein. The mark 51 is formed in, for example, a rib shape protruding inward from an inner side surface of the feed tray 11. The mark 51 is formed along the front and rear direction. The maximum number of sheets of cut paper P2 is, for example, 500 sheets.

In the illustrative embodiment, when the roll paper P1*a* is printed, the cut paper P2 is not accommodated in the second accommodation portion 11*b*. When the cut paper P2 is printed, the roll paper P1*a* is not unrolled from the roll body R accommodated in the first accommodation portion 11*a*, or the roll body R is not accommodated in the first accommodation portion 11*a*. In the illustrative embodiment, when the feed tray 11 is inserted into the housing 100*a*, at least a part of the first accommodation portion 11*a* and the whole second accommodation portion 11*b* are accommodated inside the housing 100*a*.

The feed roller 2 is located behind the first accommodation portion 11*a* and disposed near a rear end portion of the second accommodation portion 11*b*. The feed roller 2 rotates by driving a motor 70 (a drive source of the present disclosure) (refer to FIG. 3), thereby feeding the roll paper P1*a* and the cut paper P2 from the feed tray 11 to the conveyance path. As described above, the conveyance path of the roll paper P1*a* and the conveyance path of the cut paper P2 are both defined by the feed roller 2, the pair of intermediate rollers 9, the pair of conveyance rollers 3*a*, and the pair of paper discharge rollers 3*b*. Accordingly, the feed roller 2 feeds the roll paper P1*a* and the cut paper P2 along a common conveyance path.

The cutter mechanism 4 is located on a downstream side of the feed roller 2 in the conveyance direction along the conveyance path of the roll paper P1*a* and the cut paper P2 (hereinafter, also simply referred to as a "conveyance direction"), and is disposed at a position on an upstream side of the head 5 which will be described later in the conveyance direction. The cutter mechanism 4 includes, for example, a cutter 4*a* including two rotary blades and a cutting motor (not illustrated) for reciprocating the cutter 4*a* in the axial direction. The roll paper P1*a* unrolled from the roll body R and conveyed along the conveyance path is cut by the cutter 4*a* in the width direction of the roll paper P1*a* by driving the cutting motor under the control of the controller 10. Accordingly, a rear end is formed on the roll paper P1*a* to be fed to the paper discharge tray 6.

The guide 7 is located behind the feed roller 2 and provided on an upstream side of the cutter mechanism 4 in the conveyance direction. The guide 7 is provided for guiding the roll paper P1*a* and the cut paper P2 fed by the feed roller 2 to the cutter mechanism 4. As illustrated in FIG. 1, the guide 7 is inclined to be located upward from the front to the rear in the front and rear direction. The guide 7 extends long along the left and right direction, and is formed to be slightly longer than the widths of the roll paper P1*a* and the cut paper P2. A fine uneven pattern that repeats along the conveyance direction is formed on a surface of the guide 7. Here, short paper such as the cut paper P2 or the like can be separated to prevent multi feeding.

The pair of intermediate rollers 9 is located on a downstream side of the cutter mechanism 4 in the conveyance direction, and provided on an upstream side of the head 5 in the conveyance direction. The pair of intermediate rollers 9 conveys the roll paper P1*a* and the cut paper P2 to the pair of conveyance rollers 3*a*. The pair of intermediate rollers 9 is formed of a drive roller that rotates by driving the motor 70 and a driven roller that rotates in association with the rotation of the drive roller. In the illustrative embodiment, both a motor that rotationally drives the feed roller 2 and a motor that rotationally drives the pair of intermediate rollers 9 are referred to as the motor 70.

The pair of conveyance rollers 3*a* is formed of a drive roller that rotates by driving a conveying motor which is not illustrated and a driven roller that rotates in association with the rotation of the drive roller. The pair of paper discharge rollers 3*b* is formed of a drive roller that rotates by driving a paper discharging motor which is not illustrated and a driven roller that rotates in association with the rotation of the drive roller. The conveying motor and the paper discharging motor, which are not illustrated, are driven by the control of the controller 10, and the pair of conveyance rollers 3*a* and the pair of paper discharge rollers 3*b* rotate while sandwiching the roll paper P1*a* (or the cut paper P2), thereby conveying the roll paper P1*a* (or the cut paper P2). The drive roller of the pair of conveyance rollers 3*a* and the drive roller of the pair of paper discharge rollers 3*b* may be configured to be driven by a common conveying motor which is not illustrated. Here, for example, the pair of conveyance rollers 3*a* and the pair of paper discharge rollers 3*b* are connected to each other by a belt.

The head 5 forms an image on the roll paper P1*a* and the cut paper P2, is located on a downstream side of the pair of conveyance rollers 3*a* in the conveyance direction, and is located on an upstream side of the pair of paper discharge rollers 3*b* in the conveyance direction. The head 5 includes a plurality of nozzles (not illustrated) formed on a lower surface thereof and a driver IC. When the driver IC is driven by the control of the controller 10, ink is ejected from the nozzle. When the roll paper P1*a* (or the cut paper P2) conveyed by the pair of conveyance rollers 3*a* passes through a position facing the lower surface of the head 5, ink is ejected from the nozzle of the head 5, and an image is formed on the long paper P1 and the cut paper P2. The head 5 may be either a line type that ejects ink from a nozzle in a state where a position thereof is fixed, or a serial type that ejects ink from a nozzle while moving in the axial direction of the rotating shaft Rx. The roll paper P1*a* (or the cut paper P2) on which the image is formed by the head 5 is received by the paper discharge tray 6 in an open state with respect to the housing 100*a*.

In the illustrative embodiment, horizontal components in the conveyance direction of the roll paper P1*a* and the cut paper P2 fed by the feed roller 2 are disposed from the front to the rear in the front and rear direction, and horizontal components in the conveyance direction of the roll paper P1*a* and the cut paper P2 discharged to the outside from the paper discharge tray 6 in the open state through the position facing the lower surface of the head 5 are disposed from the rear to the front in the front and rear direction. That is, the printer 100 of the illustrative embodiment is formed with a so-called U-turn path configuration in which the conveyance direction is folded back in the middle.

The controller 10 is connected to the motor 70, the conveying motor, the paper discharging motor, the driver IC, the cutting motor, or the like via an internal bus (not illustrated). The controller 10 includes a central processing unit (CPU), a read only memory (ROM), and a random access memory (RAM). The ROM stores a program and data for allowing the CPU to perform various controls. The RAM temporarily stores data to be used by the CPU when executing the program.

Movement Mechanism 20

The printer 100 of the illustrative embodiment further includes a movement mechanism 20. The movement mechanism 20 includes a swing arm 20*a* that rotatably supports the feed roller 2 and a swing shaft 20*b* that supports the swing arm 20*a* to be swingable in the housing 100*a*. A rotation axis direction of the swing shaft 20*b* is parallel to the left and right direction. The swing shaft 20*b* is located below an upper end portion of the feed tray 11. In the illustrative embodiment, the upper end portion of the feed tray 11 is an upper surface of the roll cover 16. Accordingly, the swing shaft 20*b* is located below the upper surface of the roll cover 16. When the feed tray 11 is not provided with the roll cover 16, an uppermost portion of the members forming the feed tray 11 becomes the upper end portion of the feed tray 11. The swing shaft 20*b* may directly or indirectly support the swing arm 20*a* in the housing 100*a*.

Figure 2:
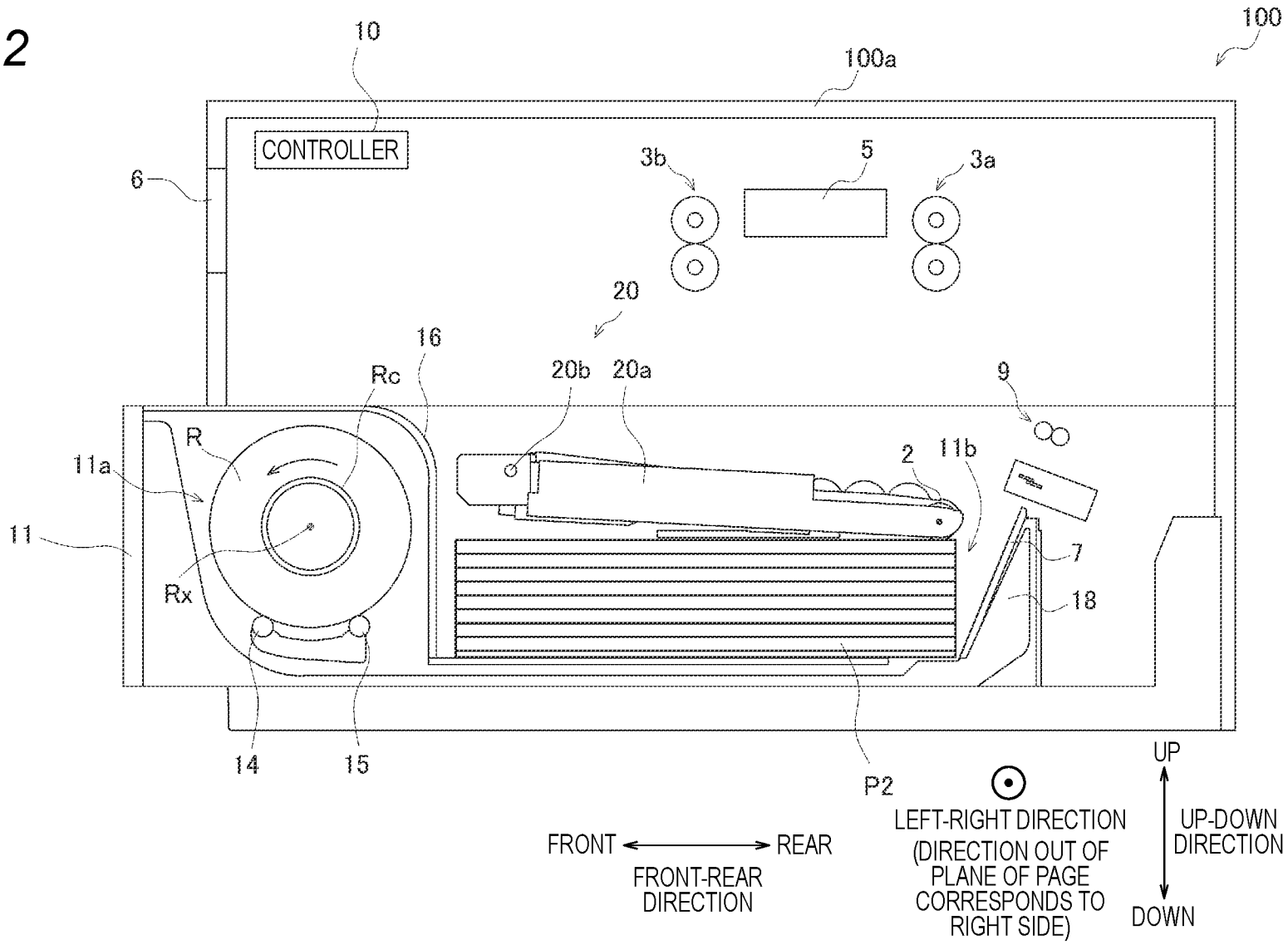
FIG. 2 is a schematic configuration diagram of the printer when cut paper is accommodated.

The movement mechanism 20 can move in the up and down direction by swinging the swing arm 20*a* around the swing shaft 20*b*. For example, when the roll paper P1*a* is printed, the movement mechanism 20 moves downward by swinging the swing arm 20*a* as illustrated in FIG. 1. Accordingly, the movement mechanism 20 can move to a position where the feed roller 20 contacts the roll paper P1*a* unrolled from the roll body R accommodated in the first accommodation portion 11*a*. When the cut paper P2 is printed, the movement mechanism 20 moves upward by swinging the swing arm 20*a* as illustrated in FIG. 2. Accordingly, the movement mechanism 20 can move to a position where the feed roller 2 contacts the uppermost cut paper P2 of the plurality of sheets of cut paper P2 in the stacked state accommodated in the second accommodation portion 11*b*. The swing of the swing arm 20*a* around the swing shaft 20*b* may be automatically performed by the controller 10 or manually performed by an operator.

Figure 3:
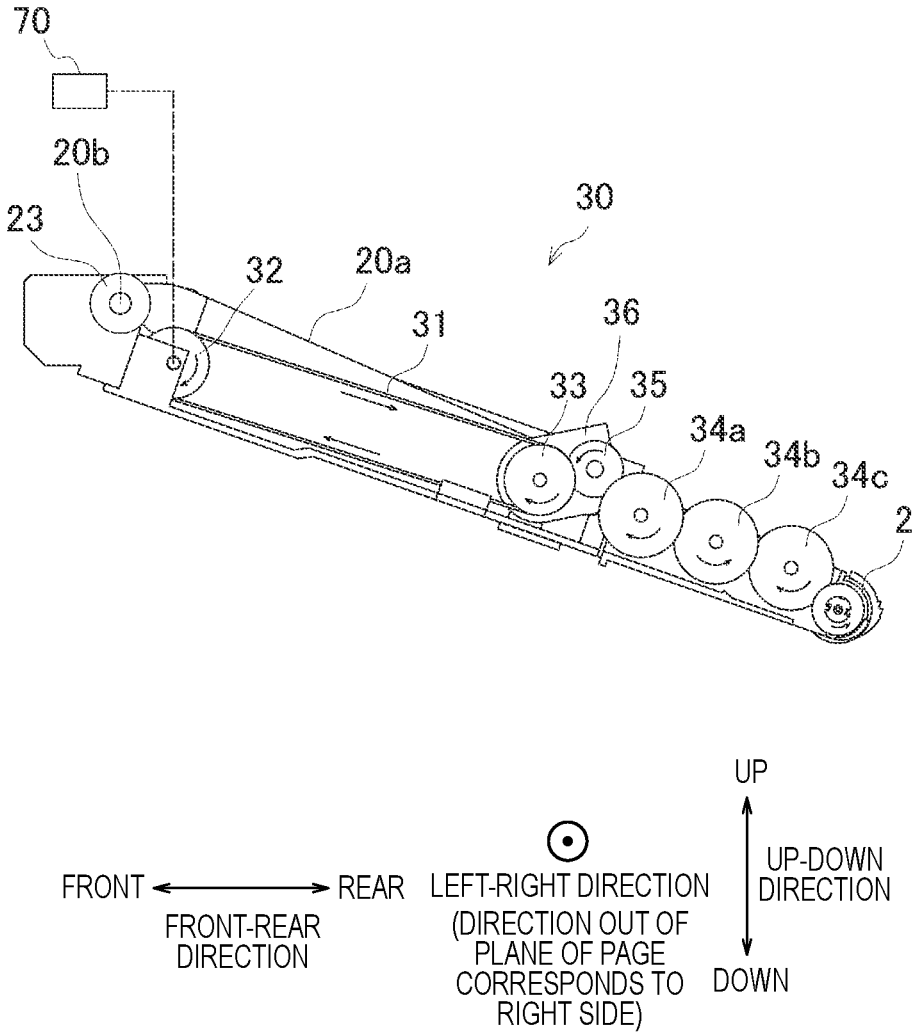
FIG. 3 is a diagram illustrating power transmission of a movement mechanism when a motor rotates in a forward direction.

As illustrated in FIG. 3, the movement mechanism 20 further includes an urge member 23 that urges the swing arm 20*a* in a direction of weakening a force applied to the roll paper P1*a* (or the cut paper P2) from the swing arm 20*a* via the feed roller 2 along the up and down direction, that is, upward. In the illustrative embodiment, the urge member 23 is mounted on a portion in contact with the swing shaft 20*b*. However, the urge member 23 may be mounted on a portion that is not in contact with the swing shaft 20*b*. In the illustrative embodiment, the urge member 23 is a spring member. However, the urge member 23 may be an elastic member other than the spring, and may be, for example, resin or the like.

Power Transmission Mechanism 30

The printer 100 of the illustrative embodiment further includes a power transmission mechanism 30 for transmitting power from the motor 70 to the feed roller 2. The power transmission mechanism 30 is mounted on the swing arm 20*a*. As illustrated in FIG. 3, the power transmission mechanism 30 includes a transmission belt 31, a drive pulley 32, a driven pulley 33, three gears 34*a* to 34*c*, a planetary gear 35, and a connecting member 36.

The transmission belt 31 is, for example, a timing belt in which groove shapes formed along a width direction of the belt are disposed along an extending direction of the belt. A groove shape that meshes with the groove of the transmission belt 31 is formed on an outer peripheral surface of the drive pulley 32 and the driven pulley 33. When the motor 70 is driven, a rotational force thereof is transmitted to the drive pulley 32 such that the drive pulley 32 rotates. The driven pulley 33 rotates as the drive pulley 32 rotates by transmitting a rotational force of the drive pulley 32 to the transmission belt 31. The driven pulley 33 includes a tooth shape that meshes with the planetary gear 35. The planetary gear 35 is in contact with the driven pulley 33 and the gear 34*a*, and is a gear for transmitting a rotational force of the driven pulley 33 to the gear 34*a*. One end portion of the connecting member 36 is rotatably supported by a shaft portion of the driven pulley 33, and the other end portion thereof is rotatably supported by a shaft portion of the planetary gear 35. Accordingly, the planetary gear 35 is supported by the connecting member 36 to be swingable around a rotating shaft of the driven pulley 33. The planetary gear 35 and the connecting member 36 in the illustrative embodiment correspond to the cut mechanism of the present disclosure. The three gears 34*a*, 34*b*, and 34*c* mesh with each other, and are gears for transmitting a rotational force transmitted from the planetary gear 35 to the feed roller 2. The gears 34*a*, 34*b*, and 34*c* in the illustrative embodiment correspond to a gear train of the present disclosure.

As described above, the motor 70 is a motor that drives the rotation of both the feed roller 2 and the pair of intermediate rollers 9. The motor 70 can be driven to rotate in a forward direction and in a reverse direction. When the motor 70 is driven to rotate in the forward direction, the roll paper P1*a* (or the cut paper P2) is fed by the feed roller 2. When the motor 70 is driven to rotate in the reverse direction, the roll paper P1*a* (or the cut paper P2) is conveyed by the pair of intermediate rollers 9.

More specifically, when the motor 70 is driven to rotate in the forward direction, as illustrated in FIG. 3, the drive pulley 32 rotates clockwise in the drawing, such that the transmission belt 31 and the driven pulley 33 also rotate clockwise in the drawing. Here, the connecting member 36 swings clockwise in FIG. 3 around the rotating shaft of the driven pulley 33, and the planetary gear 35 and the gear 34*a* are in a state of meshing with each other. Next, the planetary gear 35 meshing with the driven pulley 33 rotates counterclockwise in FIG. 3, and causes the feed roller 2 to rotate counterclockwise in FIG. 3 via the gears 34*a* to 34*c*, that is, causes the feed roller 2 to rotates in a direction of conveying the roll paper P1*a* (or the cut paper P2). That is, when the motor 70 rotates in the forward direction, the power is transmitted to the feed roller 2.

Figure 4:
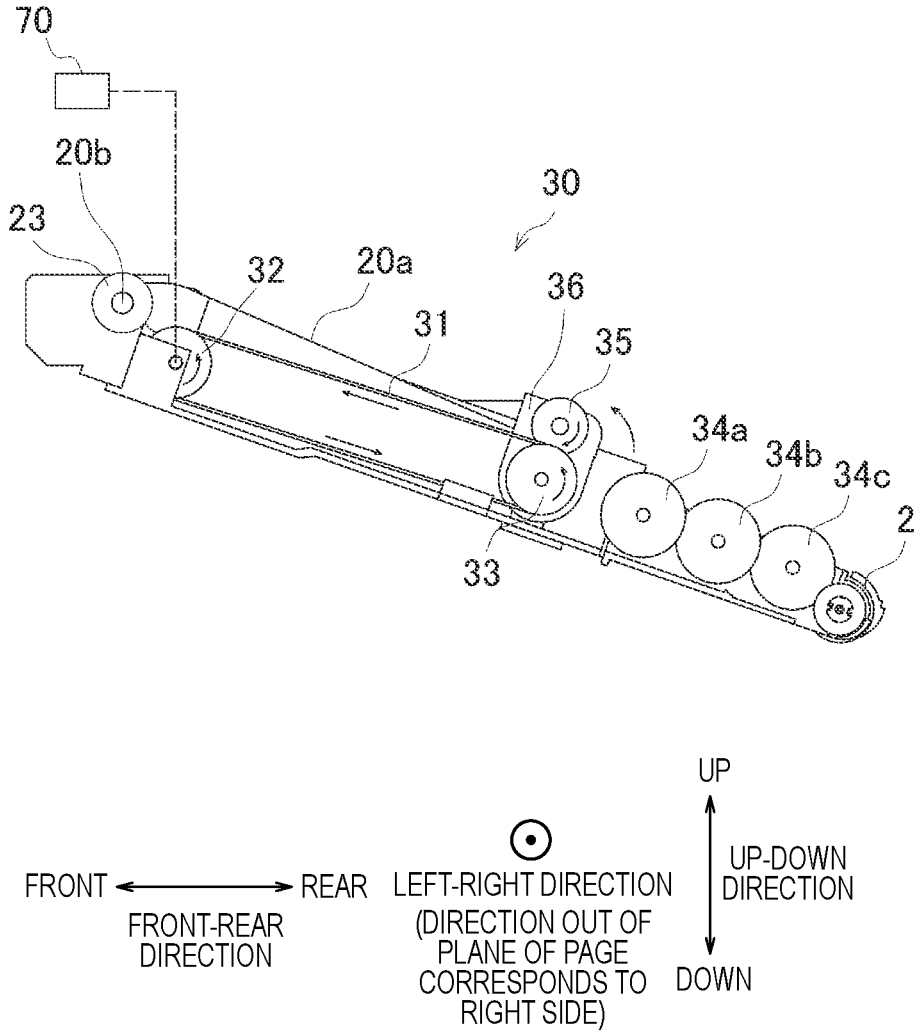
FIG. 4 is a diagram illustrating the power transmission of the movement mechanism when the motor rotates in a reverse direction.

When the motor 70 is driven to rotate in the reverse direction, as illustrated in FIG. 4, the drive pulley 32 rotates counterclockwise in the drawing, such that the transmission belt 31 and the driven pulley 33 also rotate counterclockwise in the drawing. Here, the connecting member 36 swings counterclockwise in FIG. 3 (refer to a solid line arrow in FIG. 4) around the rotating shaft of the driven pulley, and the planetary gear 35 and the gear 34*a* are in a state of being separated from each other. Therefore, the rotation of the planetary gear 35 is not transmitted to the gears 34*a* to 34*c* and the feed roller 2. That is, when the motor 70 rotates in the reverse direction in order to cause the pair of intermediate rollers 9 to rotate, the transmission of the power to the feed roller 2 is in a state of being cut off.

Retractable Mechanism 40

Figure 5:
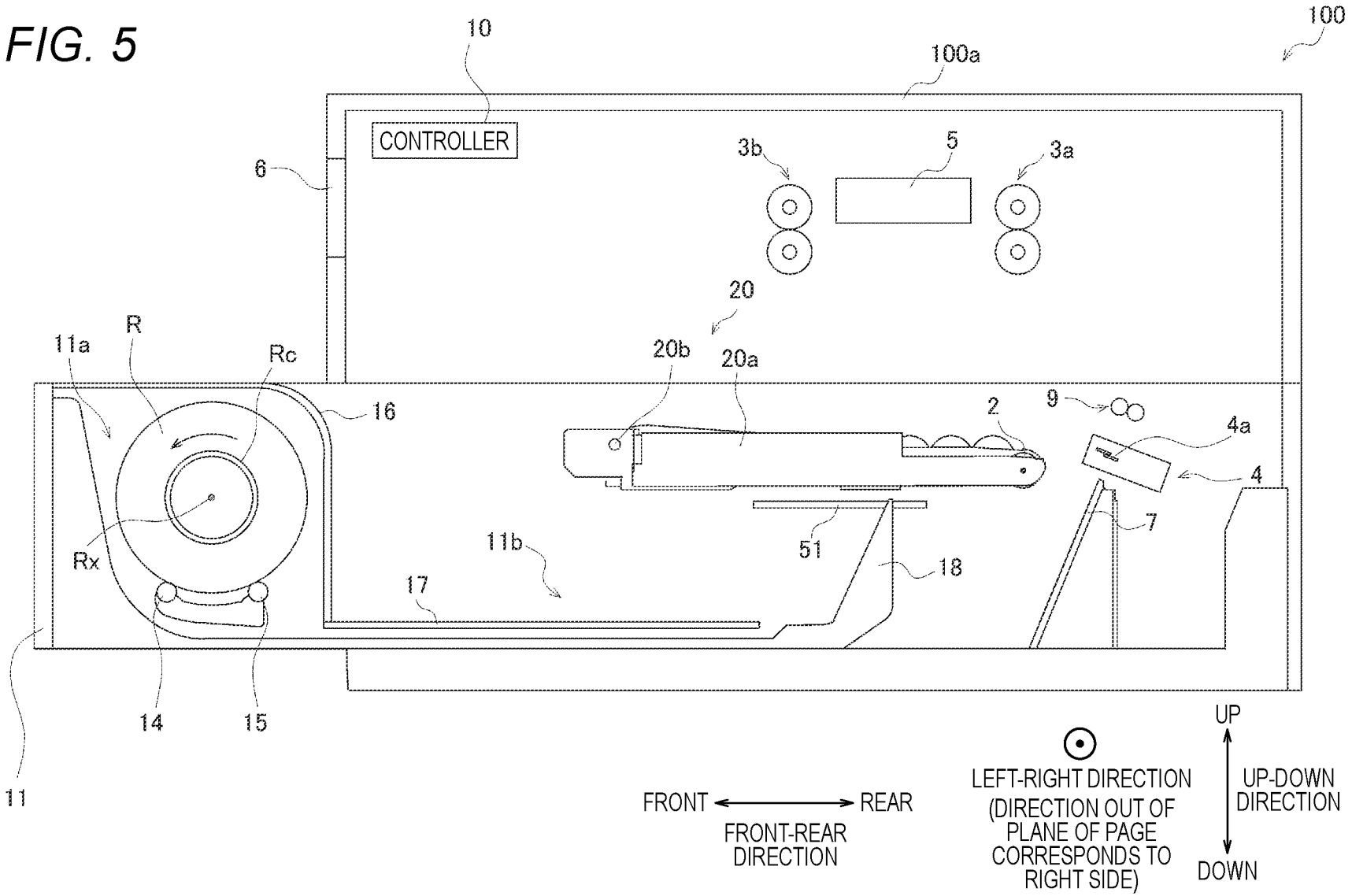
FIG. 5 is a schematic configuration diagram of the printer when a feed tray is inserted and removed.

The printer 100 of the illustrative embodiment further includes a retractable mechanism 40 that causes the feed roller 2 and the swing arm 20*a* to retract above the convex portion 18 of the feed tray 11 as illustrated in FIG. 5 when the feed tray 11 is inserted into and removed from the housing 100*a*. The retractable mechanism 40 includes a horizontal surface 41*a*, inclined surfaces 41*b* and 41*c*, and a cylindrical member 43 of a side wall 41 of the feed tray 11. Hereinafter, the retractable mechanism will be described with reference to FIGS. 6 and 7.

Figure 6:
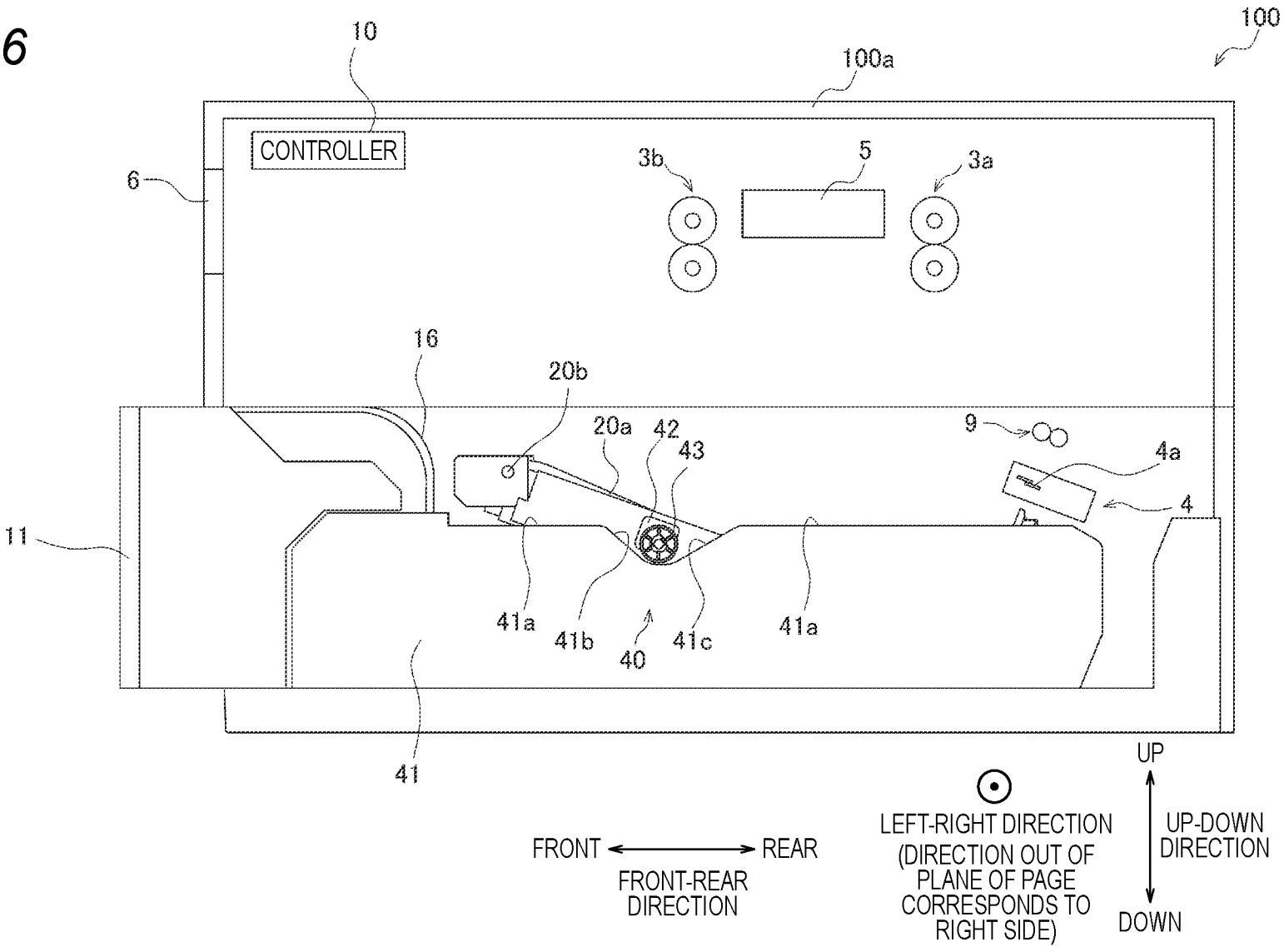
FIG. 6 is a schematic configuration diagram of a retractable mechanism when the feed tray is inserted into a housing.

As illustrated in FIG. 6, the cylindrical member 43 is supported at a tip of an extending portion 42 extending, toward the right side and the left side in the left and right direction, from the swing arm 20*a* to positions of the side walls 41 on both sides of the feed tray 11. The horizontal surface 41*a* and the inclined surfaces 41*b* and 41*c* are formed on an upper portion of the side wall 41 of the feed tray 11. The inclined surface 41*b* is inclined downward from the front to the rear in the vicinity of a center of the horizontal surface 41*a* extending horizontally over the whole upper portion of the side wall 41. The inclined surface 41*c* is inclined upward from the front to the rear at a position in the vicinity of the center of the horizontal surface 41*a* and behind the inclined surface 41*b*. A rear end of the inclined surface 41*b* and a front end of the inclined surface 41*c* are connected to each other, a front end of the inclined surface 41*b* is connected to the horizontal surface 41*a*, and a rear end of the inclined surface 41*c* is connected to the horizontal surface 41*a*. The cylindrical member 43 can move along the horizontal surface 41*a* and the inclined surfaces 41*b* and 41*c*.

Figure 7:
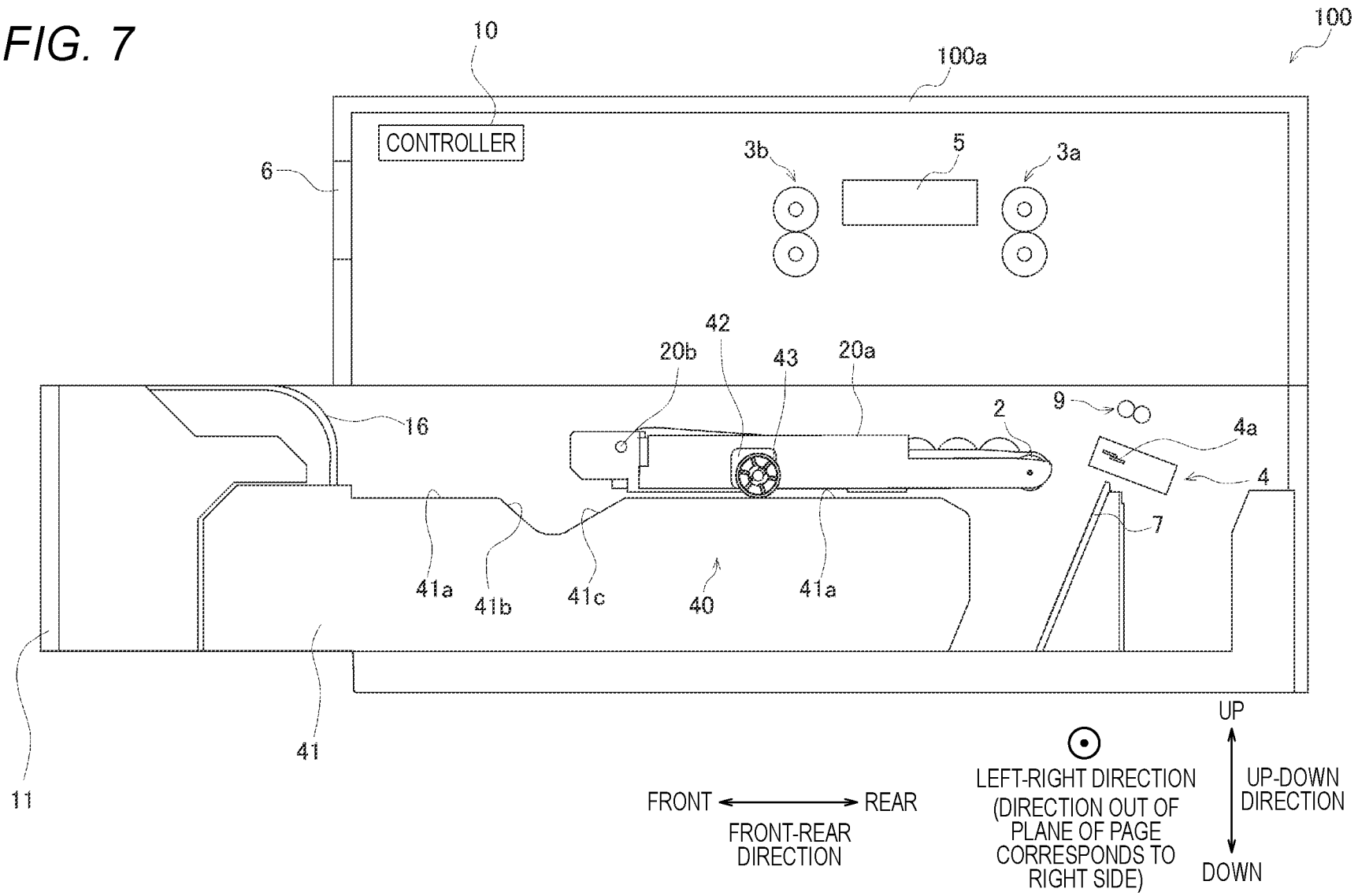
FIG. 7 is a schematic configuration diagram of the retractable mechanism when the feed tray is inserted and removed.

When the feed tray 11 is inserted into the housing 100*a*, as illustrated in FIG. 6, the cylindrical member 43 is disposed above the vicinity of a connecting point between the inclined surface 41*b* and the inclined surface 41*c*. Here, the movement mechanism 20 moves to a position where the feed roller 2 contacts the roll paper P1*a* or a position where the feed roller 2 contacts the cut paper P2. On the other hand, when the feed tray 11 is removed from the housing 100*a*, or when the feed tray 11 is inserted into the housing 100*a* in a state where the feed tray 11 is removed from the housing 100*a*, as the feed tray 11 moves forward with respect to the housing 100*a*, as illustrated in FIG. 7, the cylindrical member 43 is disposed on the horizontal surface 41*a* behind the inclined surface 41*c*. Accordingly, as illustrated in FIG. 5, the swing arm 20*a* and the feed roller 2 can move to a position where the swing arm 20*a* and the feed roller 2 retract above the convex portion 18 when the feed tray 11 is inserted into and removed from the housing 100*a*.

As described above, in the printer 100 of the illustrative embodiment, the movement mechanism 20 causes the swing arm 20*a* to moves around the swing shaft 20*b*, whereby the movement mechanism 20 can move to the position (refer to FIG. 1) where the feed roller 2 contacts the roll paper P1*a* unrolled from the roll body R accommodated in the first accommodation portion 11*a*, and can move to the position (refer to FIG. 2) where the feed roller 2 contacts the cut paper P2 accommodated in the second accommodation portion 11*b*. Accordingly, the roll body R accommodated in the first accommodation portion 11*a* or the cut paper P2 accommodated in the second accommodation portion 11*b* can be selectively conveyed by the common feed roller 2. As a result, the printer 100 including the feed tray 11 accommodating both the roll body R and the cut paper P2 can prevent an increase in size of the device. The feeding by the feed roller 2 can be performed corresponding to both a height of the roll paper P1*a* unrolled from the roll body R and a height of the cut paper P2 in the stacked state.

The feed roller 2 of the illustrative embodiment can feed the roll paper P1*a* unrolled from the roll body R and the cut paper P2 along the common conveyance path. Accordingly, space saving can be achieved as compared with a case where a conveyance path for the roll paper P1*a* and a conveyance path for the cut paper P2 are separately provided. Therefore, it is possible to further prevent the increase in size of the device.

The swing shaft 20*b* of the illustrative embodiment is located below the upper end portion (an upper end surface of the roll cover 16) of the feed tray 11. Accordingly, a height dimension of the device can be reduced as compared with a case where the swing shaft 20*b* is located above the upper end portion of the feed tray 11.

The printer 100 of the illustrative embodiment further includes the power transmission mechanism 30 mounted on the swing arm 20*a* for transmitting the power from the motor 70 to the feed roller 2. The power transmission mechanism 30 includes the transmission belt 31 and the gear train (the gears 34*a*, 34*b*, and 34*c*). Accordingly, a gear loss can be prevented as compared with a case where the power from the motor 70 is transmitted only by the gear, thereby improving efficiency of transmitting the power to the feed roller 2.

The power transmission mechanism 30 of the illustrative embodiment further includes the planetary gear 35 and the connecting member 36 disposed between the transmission belt 31 and the feed roller 2. The planetary gear 35 and the connecting member 36 are configured to selectively take a state in which the power is transmitted from the motor 70 to the feed roller 2 and a state in which the power transmission is cut off. After the roll paper P1*a* (or the cut paper P2) is conveyed by the feed roller 2 to another roller (the pair of intermediate rollers 9 in the illustrative embodiment) located on the downstream side of the feed roller 2 in the conveyance direction, the roll paper P1*a* (or the cut paper P2) is continuously conveyed by the pair of intermediate rollers 9. Here, when the motor 70 and the feed roller 2 are electrically connected to each other and the power from the motor 70 is transmitted to the feed roller 2, the roll paper P1*a* (or the cut paper P2) receives a load from the feed roller 2 in a direction opposite to the conveyance direction. The load becomes conveyance resistance of the roll paper P1*a* (or the cut paper P2), which may adversely affect an image quality formed by the head 5. When the feed roller 2 is supported by the swing arm 20*a* as shown in the illustrative embodiment, the swing arm 20*a* swings up and down every time the conveyance is performed such that noise is generated. Therefore, the above-described problem can be avoided by rotating the feed roller 2 in the reverse direction after conveying the roll paper P1*a* (or the cut paper P2) to the pair of intermediate rollers 9 and by cutting off the transmission of the power to the feed rollers 2. The planetary gear 35 and the connecting member 36 may be disposed at a position close to the feed roller 2 between the transmission belt 31 and the feed roller 2. It is because as the planetary gear 35 and the connecting member 36 move away from the feed roller 2, a load caused by the meshing of the gears increases such that transmission efficiency of the power deteriorates.

The movement mechanism 20 of the illustrative embodiment further includes the urge member 23 that urges the swing arm 20*a* in the direction of weakening the force applied to the roll paper P1*a* (or the cut paper P2) from the swing arm 20*a* along the up and down direction. A vertical force applied to the cut paper P2 from the swing arm 20*a* along the up and down direction increases by a weight of the swing arm 20*a*, such that a plurality of sheets of cut paper P2 accommodated in the second accommodation portion 11*b* in the stacked state may be conveyed together by mistake. According to the illustrative embodiment, a plurality of sheets of cut paper P2 can be prevented from being conveyed together.

In the illustrative embodiment, the swing shaft 20*b* is supported by the housing 100*a*, and the convex portion 18 extending upward is formed at an upstream end portion in a direction of removing the feed tray 11 from the housing 100*a*. Next, the swing arm 20*a* and the feed roller 2 move to the position where the swing arm 20*a* and the feed roller 2 retract above the convex portion 18 when the feed tray 11 is inserted into and removed from the housing 100*a*. Accordingly, in the printer 100 having a configuration in which the convex portion 18 is formed on the feed tray 11, when the feed tray 11 is inserted into and removed from the housing 100*a*, it is possible to avoid interference with insertion and removal caused by allowing the feed roller 2 and the swing arm 20*a* to contact the convex portion 18.

Second Illustrative Embodiment

Figure 8:
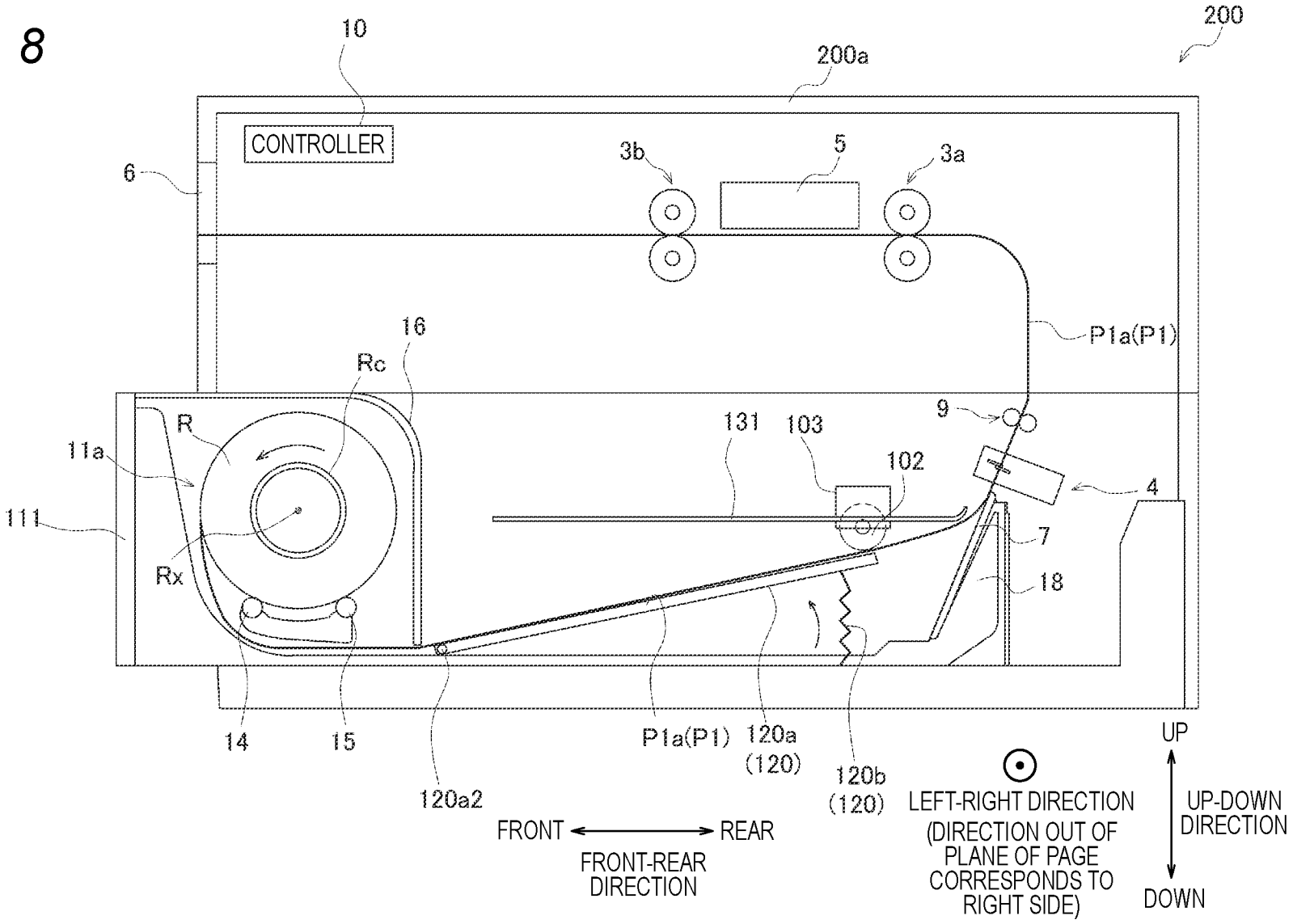
FIG. 8 is a schematic configuration diagram of a printer according to a second illustrative embodiment of the present disclosure.
Figure 9:
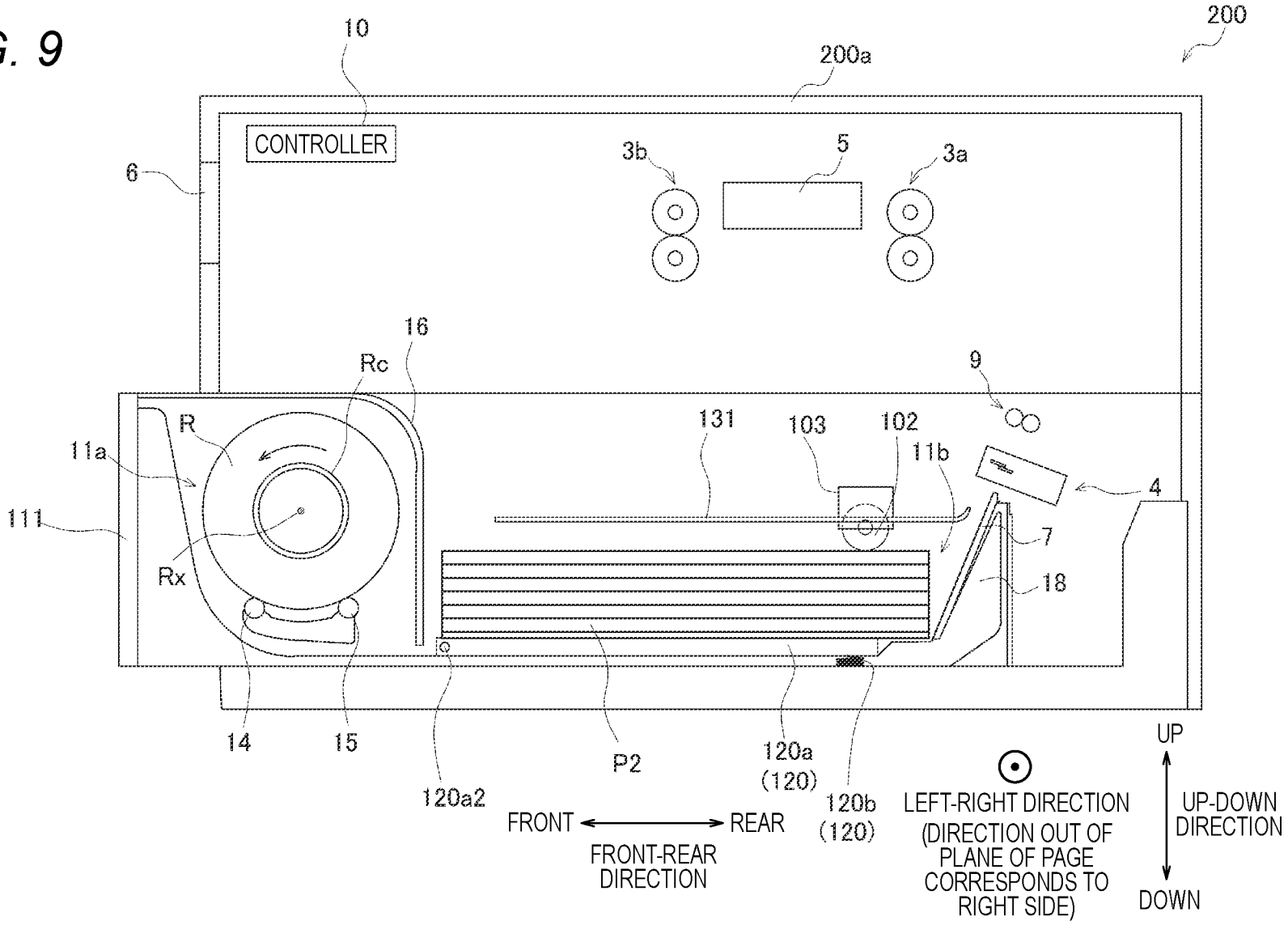
FIG. 9 is a schematic configuration diagram of the printer of the second illustrative embodiment when the cut paper is accommodated.
Figure 10:
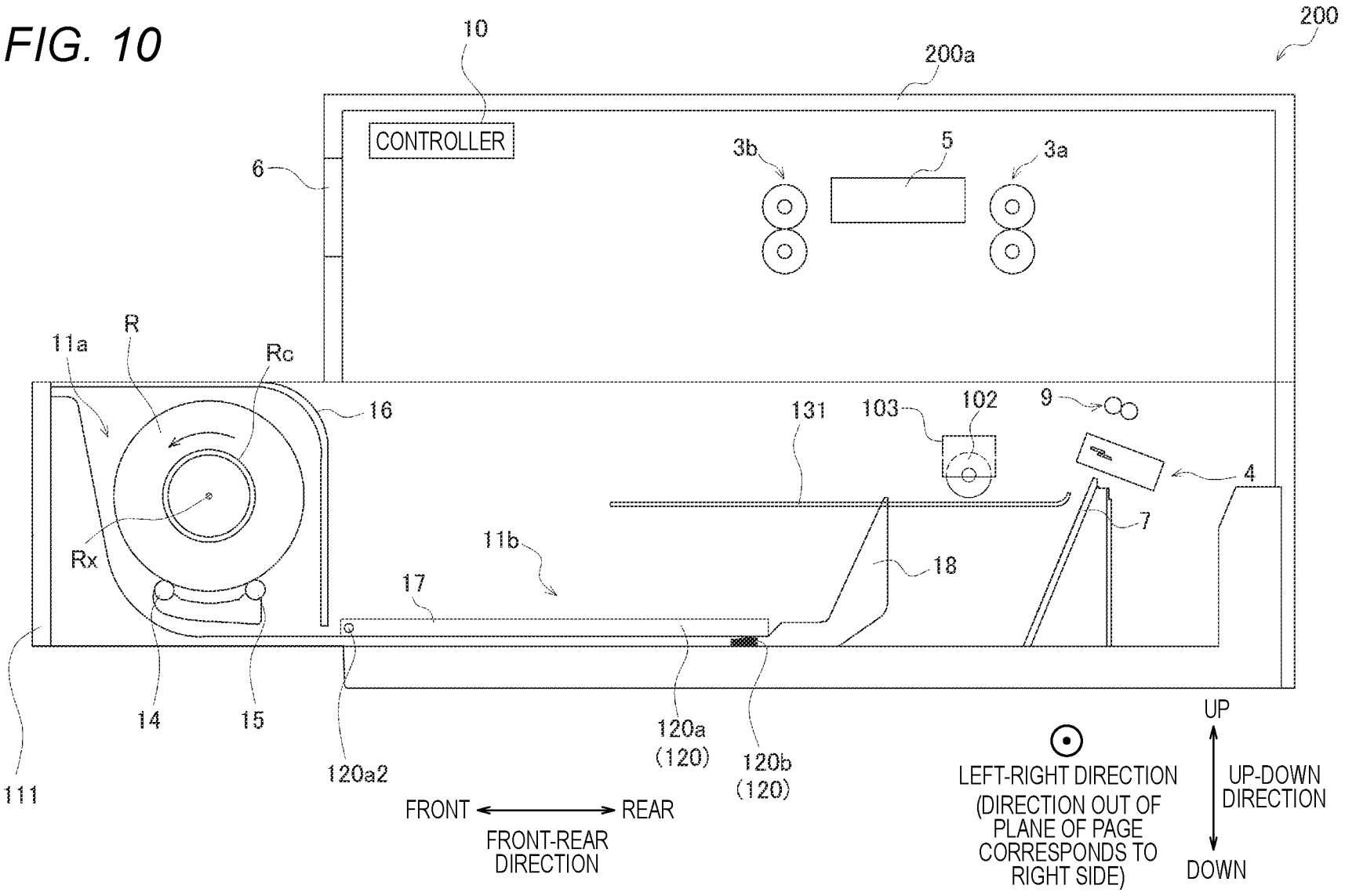
FIG. 10 is a schematic configuration diagram of the printer according to the second illustrative embodiment when the feed tray is inserted and removed.

Next, a second illustrative embodiment of the present disclosure will be described with reference to FIGS. 8 to 10. In the following description, the same configurations as those of the first illustrative embodiment will be denoted by the same reference signs, and the description thereof will be omitted.

In a printer 200 according to the second illustrative embodiment, a movement mechanism 120 supports the roll paper P1*a* unrolled from the roll body R or the cut paper P2 from below, and includes a pressure plate 120*a* that is displaceable in the up and down direction and a pressure plate drive portion 120*b* configured to displace the pressure plate 120*a* in the up and down direction. The pressure plate 120*a* is a plate-shaped member extending in the front and rear direction and the left and right direction. The pressure plate 120*a* is mounted on the feed tray 111. The pressure plate 120*a* is displaceable in the up and down direction by rotating around one end portion 120*a*2 on the front side. An axial direction of one end portion 120*a*2, that is, a rotating shaft of the pressure plate 120*a* is parallel to the left and right direction.

The pressure plate drive portion 120*b* is a member that displaces the pressure plate 120*a* in the up and down direction. The pressure plate drive portion 120*b* includes, for example, an operating member (not illustrated) configured to swing in the up and down direction, a motor (not illustrated) configured to supply a driving force for moving the pressure plate 120*a* upward, and a drive transmission unit (not illustrated) configured to transmit the driving force supplied from the motor to the operating member. The operating member is in contact with the pressure plate 120*a*, and moves the pressure plate 120*a* upward when the driving force from the motor is supplied thereto. The drive transmission unit includes a plurality of rotating bodies such as gears or the like. JP-A-2007-269462, JP-A-2017-071492, or the like describe more detailed information thereon.

The pressure plate 120*a* is displaced in the up and down direction by the pressure plate drive portion 120*b*, such that the movement mechanism 120 is movable to a position where the feed roller 102 contacts the roll paper P1*a* unrolled from the roll body R, and is movable to a position where the feed roller 102 contacts the cut paper P2. For example, when the roll paper P1*a* is printed, as illustrated in FIG. 8, the movement mechanism 120 moves upward by rotating the pressure plate 120*a* around one end portion 120*a*2 on the front side (refer to a solid line arrow in FIG. 8). Accordingly, the movement mechanism 120 is movable to a position where the feed roller 102 contacts the roll paper P1*a* unrolled from the roll body R accommodated in the first accommodation portion 11*a*. When the cut paper P2 is printed, as illustrated in FIG. 9, the movement mechanism 120 moves downward by rotating the pressure plate 120*a* around one end portion 120*a*2 on the front side (refer to FIG. 9). Accordingly, the movement mechanism 120 is movable to a position where the feed roller 102 contacts the uppermost cut paper P2 of the plurality of sheets of cut paper P2 accommodated in the stacked state in the second accommodation portion 11*b*.

In a housing 200*a* of the printer 200 according to the second illustrative embodiment, a plate-shaped member 131 extending in the conveyance direction along the conveyance path of the roll paper P1*a* unrolled from the roll body R, that is, extending along the front and rear direction is disposed at a position higher than the maximum height position when the maximum number of sheets of cut paper P2 are accommodated in the second accommodation portion 11*b*. In the second illustrative embodiment, the plate-shaped member 131 extends from a position on the front side of the feed roller 102 to a position on the rear side of the feed roller 102. The plate-shaped member 131 extends along the left and right direction and is formed to be slightly longer than the widths of the roll paper P1*a* and the cut paper P2. The plate-shaped member 131 is notched to not overlap with the feed roller 102 when viewed from the up and down direction. The printer 200 includes a retractable mechanism (not illustrated) that retracts the feed roller 102 to a position higher than a position of the plate-shaped member 131 when the feed tray 111 is inserted into and removed from the housing 200*a*.

A configuration of the retractable mechanism may be, for example, a configuration including a horizontal surface, an inclined surface, and a cylindrical member of the side wall of the feed tray in the same manner as that of the configuration of the retractable mechanism 40 of the first illustrative embodiment described above. However, the printer 200 of the second illustrative embodiment is different from that of the first illustrative embodiment in that the printer 200 of the second illustrative embodiment does not include the swing arm. Therefore, the cylindrical member is supported at a tip of an extending portion extending, toward the right side and the left side in the left and right direction, from the support member 103 that supports the feed roller 102 in the housing 200*a* to positions of the side walls on both sides of the feed tray 111. By the retractable mechanism, as illustrated in FIG. 10, the feed roller 102, at least a part of which is located below the plate-shaped member 131, is movable to a position where the feed roller 102 retracts above the plate-shaped member 131, when the feed tray 111 is inserted into and removed from the housing 200*a*.

As described above, in the printer 200 of the second illustrative embodiment, the movement mechanism 120 includes the pressure plate 120*a* that is configured to support the roll paper P1*a* unrolled from the roll body R or the cut paper P2 from below and is displaceable in the up and down direction, and the pressure plate drive portion 120*b* configured to displace the pressure plate 120*a* in the up and down direction. The pressure plate 120*a* is displaced in the up and down direction, such that the movement mechanism 120 is movable to the position where the feed roller 102 contacts the roll paper P1*a* unrolled from the roll body R, and is movable to the position where the feed roller 102 contacts the cut paper P2. Accordingly, it becomes possible to perform the feeding by the feed roller 102 corresponding to both the height of the roll paper P1*a* and the height of the cut paper P2 in the stacked state.

In the housing 200*a* of the printer 200 of the second illustrative embodiment, the plate-shaped member 131 extending along the conveyance direction along the conveyance path of the roll paper P1*a* is disposed at the position higher than the maximum height position when the maximum number of sheets of cut paper P2 are accommodated in the second accommodation portion 11*b*. The feed roller 102 is movable to the position where the feed roller 102 retracts above the plate-shaped member 131 when the feed tray 111 is inserted into and removed from the housing 200*a*. The printer 200 that forms an image on the roll paper P1*a* includes the cutter mechanism 4 that cuts the roll paper P1*a*. When the roll paper P1*a* is cut by the cutter mechanism 4, the roll paper P1*a* may remain in a conveyance path from the first accommodation portion 11*a* to the cutter mechanism 4. Here, when the feed tray 111 is inserted into and removed from the housing 200*a*, a tip of the roll paper P1*a* remaining in the conveyance path from the first accommodation portion 11*a* to the cutter mechanism 4 may contact the feed roller 102. According to the second illustrative embodiment, it is possible to prevent the tip of the roll paper P1*a* from contacting the feed roller 102 when the feed tray 111 is inserted into and removed from the housing 200*a*.

Modifications

While the illustrative embodiments of the present disclosure have been described above, the present invention is not limited to the above-described illustrative embodiments, and various modifications may be made within the scope of the present disclosure.

In the first illustrative embodiment, the feed roller 2 is supported by the housing 100*a* via the swing arm 20*a* and the swing shaft 20*b*. However, the feed roller 2 may be supported by the feed tray 11 via the swing arm 20*a* and the swing shaft 20*b*. In the second illustrative embodiment, the feed roller 102 may be directly or indirectly supported by the housing 200*a*, or may be directly or indirectly supported by the feed tray 111.

In the first illustrative embodiment, the retractable mechanism 40 may not be disposed. In this case, the convex portion 18 may not be formed at the rear end portion of the feed tray 11, or the convex portion 18 is disposed at a position where the convex portion 18 does not overlap with the feed roller 2 and the swing arm 20*a* in the left and right direction when viewed from the front and rear direction. Accordingly, when the feed tray 11 is inserted into and removed from the housing 100*a*, it is possible to avoid interference with insertion and removal caused by allowing the feed roller 2 and the swing arm 20*a* to contact the convex portion 18.

In the first illustrative embodiment, when the swing arm 20*a* and the feed roller 2 are inserted into and removed from the housing 100*a* of the feed tray 11, the swing arm 20*a* and the feed roller 2 may move to a position where the swing arm 20*a* and the feed roller 2 retract above the mark 51 indicating the maximum height position when the maximum number of sheets of cut paper P2 are accommodated. Accordingly, when the feed tray 11 is inserted into and removed from the housing 100*a*, it is possible to avoid interference with insertion and removal and damage to the cut paper P2 caused by allowing the feed roller 2 and the swing arm 20*a* to contact the cut paper P2 accommodated in the second accommodation portion 11*b*.

In the first illustrative embodiment, the roll paper P1*a* unrolled from the roll body R accommodated in the first accommodation portion 11*a* is fed to the feed roller 2 through a path below the bottom surface 17 of the second accommodation portion 11*b*. However, the path may not be formed below the bottom surface 17. Here, the roll paper P1*a* unrolled from the roll body R accommodated in the first accommodation portion 11*a* is fed to the feed roller 2 through an upper side of the bottom surface 17 of the second accommodation portion 11*b*.

In the first and second illustrative embodiments described above, the feed roller 2 may be configured to convey the roll paper P1*a* and the cut paper P2 along at least a partially different conveyance path. Here, for example, a pair of intermediate rollers, a pair of conveyance rollers, and a pair of paper discharge rollers for conveying the roll paper P1*a*, and a pair of intermediate rollers, a pair of conveyance rollers, and a pair of paper discharge rollers for conveying the cut paper P2 may be separately provided. At least one of the pair of intermediate rollers, the pair of conveyance rollers, and the pair of paper discharge rollers may be common to the roll paper P1*a* and the cut paper P2.

In the first illustrative embodiment, the plate-shaped member extending in the conveyance direction along the conveyance path of the roll paper P1*a* unrolled from the roll body R, that is, extending along the front and rear direction may be disposed at a position higher than the maximum height position when the maximum number of sheets of cut paper P2 are accommodated in the second accommodation portion 11*b*. Here, the plate-shaped member extends along the left and right direction and is formed to be slightly longer than the widths of the roll paper P1*a* and the cut paper P2. The plate-shaped member is notched to not overlap with the feed roller 2 and the swing arm 20*a* when viewed from the up and down direction. Here, the swing arm 20*a* and the feed roller 2 may be configured to move to a position where the swing arm 20*a* and the feed roller 2 retract above the feeding plate-shaped member when the feed tray 11 is inserted into and removed from the housing 100*a*. The printer 100 that forms an image on the roll paper P1*a* includes the cutter mechanism 4 that cuts the roll paper P1*a*. When the roll paper P1*a* is cut by the cutter mechanism 4, the roll paper P1*a* may remain in the conveyance path from the first accommodation portion 11*a* to the cutter mechanism 4. Here, when the feed tray 11 is inserted into and removed from the housing 100*a*, the tip of the roll paper P1*a* remaining in the conveyance path from the first accommodation portion 11*a* to the cutter mechanism 4 may contact the feed roller 2. According to the above-described configuration, it is possible to prevent the tip of the roll paper P1*a* from contacting the feed roller 2 when the feed tray 11 is inserted into and removed from the housing 100*a*. For example, the plate-shaped member may extend from a position on a front side of the swing shaft 20*b* to a position on a rear side of the feed roller 2, or may extend from the position on the front side of the swing shaft 20*b* to a position on a front side of the feed roller 2 in the front and rear direction. A length of the plate-shaped member in the front and rear direction may be appropriately adjusted depending on a degree of curl of the roll paper P1*a*.

In the second illustrative embodiment, the pressure plate 120 is mounted on the feed tray 111. However, the pressure plate 120 may be mounted on the housing 200*a*. Here, the pressure plate 120 and the component of the feed tray 111 may not contact each other when the feed tray 111 is inserted into and removed from the housing 200*a*.

In the illustrative embodiment, the second accommodation portion 11*b* is located behind the first accommodation portion 11*a*. However, the second accommodation portion 11*b* may be located in front of the first accommodation portion 11*a*. Here, for example, the roll paper P1*a* unrolled from the roll body R accommodated in the first accommodation portion 11*a* may be fed from the rear to the front in the front and rear direction and then fed by the feed roller. After the roll paper P1*a* and the cut paper P2 are fed from the rear to the front by the feed roller, the roll paper P1*a* and the cut paper P2 may be configured to be fed from the front to the rear by a roller disposed on the downstream side of the conveyance direction along the conveyance path, to be further fed from the rear to the front by a roller disposed on the downstream side of the conveyance direction, and to be guided to the head. That is, the conveyance path of the roll paper P1*a* and the cut paper P2 may be configured to be a S-shape.

In the first and second illustrative embodiments described above, the feed tray is insertable into and removable from the housing in the front and rear direction. However, the feed tray may be configured to be insertable into and removable from the housing in the left and right direction.

The image forming apparatus according to the present disclosure may be applied not only to the printer 100 but also to a multifunctional printer, a copier, or the like. The printer is not limited to an inkjet type and may be a laser type. The sheet-shaped medium according to the present disclosure may be a cloth, a label, or the like in addition to paper.

In the illustrative embodiment, the paper discharge tray 6 forms an upper front side wall of the housing 100*a* and is openable and closable with respect to the housing 100*a*. However, the paper discharge tray 6 may be configured to be disposed so that a paper placing surface is parallel to the conveyance direction of paper, and may be configured to be expandable and contractable in a horizontal direction of the housing 100*a*.

When a weight of the swing arm 20*a* is large, the vertical force applied to the cut paper P2 from the swing arm 20*a* becomes large due to the weight thereof, such that a plurality of sheets of the cut paper P2 may be erroneously conveyed together. In order to prevent the above-described problem, the movement mechanism 20 of the first illustrative embodiment includes the urge member 23 that urges the swing arm 20*a* in the direction of weakening the force applied to the roll paper P1*a* (or the cut paper P2) from the swing arm 20*a*, that is, upward. However, for example, when the swing arm is formed of a lightweight member, the vertical force applied to the roll paper P1*a* (or the cut paper P2) from the swing arm is reduced, such that a feeding force of the roll paper P1*a* (or the cut paper P2) by the feed roller supported by the swing arm may be insufficient. Here, the movement mechanism may include an urge member that urges the swing arm downward. In either case of the urge member that urges the swing arm upward or the urge member that urges the swing arm downward, an urging force may be adjusted so that a sufficient feeding force by the feed roller can be obtained while a plurality of sheets of cut paper P2 are prevented from being erroneously conveyed together.

What is claimed is:

1. An image forming apparatus comprising:
a housing;
a feed tray insertable into and drawable from the housing, the feed tray being configured to accommodate a sheet-shaped medium;
a feed roller configured to feed the sheet-shaped medium from the feed tray toward a conveyance path;
an image forming device configured to form an image on the sheet-shaped medium in the conveyance path; and
a movement mechanism configured to move to a first position and a second position,
in a case the movement mechanism is in the first position, the feed roller configured to contact a first sheet-shaped medium unrolled from a roll body accommodated in the feed tray to feed the first sheet-shaped medium, and
in a case the movement mechanism is in the second position, the feed roller configured to contact a second sheet-shaped medium, the feed tray configured to accommodate a plurality of second sheet-shaped media in a stacked state,
wherein the feed roller is disposed at an upstream side of a cut mechanism in a conveyance direction.

2. The image forming apparatus according to claim 1, wherein the feed roller is configured to feed the first sheet-shaped medium and the second sheet-shaped medium along a common conveyance path.

3. The image forming apparatus according to claim 1, wherein the feed tray comprises:
a first accommodation portion configured to accommodate the roll body; and
a second accommodation portion configured to accommodate the plurality of second sheet-shaped media.

4. The image forming apparatus according to claim 3, wherein the movement mechanism further comprises:
a swing arm configured to rotatably support the feed roller; and
a swing shaft configured to support the swing arm to be swingable,
wherein the swing shaft is supported by the housing,
wherein the second accommodation portion has a mark indicating a maximum height position in a case the maximum number of the second sheet-shaped media is accommodated, and
wherein the swing arm is configured to move to a retraction position when the feed tray is inserted into and removed from the housing, the retraction position being above the mark.

5. The image forming apparatus according to claim 3, wherein the movement mechanism further comprises:
a swing arm configured to rotatably support the feed roller; and
a swing shaft configured to support the swing arm to be swingable,
wherein the swing shaft is supported by the housing,
wherein the housing comprises a plate-shaped member extending in a conveyance direction along the conveyance path of the first sheet-shaped medium, the plate-shaped member being disposed at a position higher than a maximum height position in a case the maximum number of the second sheet-shaped media is accommodated in the second accommodation portion, and
wherein the swing arm is configured to move to a retraction position when the feed tray is inserted into and removed from the housing, the retraction position being above the plate-shaped member.

6. The image forming apparatus according to claim 3, wherein the housing comprises a plate-shaped member extending in a conveyance direction along the conveyance path of the first sheet-shaped medium, the plate-shaped member being disposed at a position higher than a maximum height position when the maximum number of the second sheet-shaped media is accommodated in the second accommodation portion, and
wherein the feed roller is configured to move to a retraction position when the feed tray is inserted into and removed from the housing, the retraction position being above the plate-shaped member.

7. The image forming apparatus according to claim 3, wherein the movement mechanism further comprises:
a swing arm configured to rotatably support the feed roller;
a swing shaft configured to support the swing arm to be swingable; and
an urge member configured to urge the swing arm in a direction away from a bottom surface of the second accommodation portion.

8. The image forming apparatus according to claim 7, wherein the swing arm has:
a first end portion coupled to the swing shaft; and
a second end portion supporting the feed roller, the second end portion being opposite to the first end portion, and
wherein the urge member is configured to urge the first end portion of the swing arm in the direction away from the bottom surface of the second accommodation portion.

9. The image forming apparatus according to claim 1, wherein the movement mechanism further comprises:
a pressure plate configured to support each sheet-shaped medium from below, the pressure plate being displaceable in the up and down direction; and
a pressure plate drive portion configured to displace the pressure plate in the up and down direction.

10. The image forming apparatus according to claim 1, wherein the first sheet-shaped medium is uncut when fed onto the movement mechanism.

11. The image forming apparatus according to claim 1, wherein the cut mechanism is disposed downstream in a conveyance direction from a tip of the second sheet-shaped medium accommodated in a second accommodation portion.

12. The image forming apparatus according to claim 1, wherein the feed roller feeds the first sheet-shaped medium unrolled from below the roll body.

13. An image forming apparatus comprising:
a housing;
a feed tray insertable into and drawable from the housing, the feed tray being configured to accommodate a sheet-shaped medium;
a feed roller configured to feed the sheet-shaped medium from the feed tray toward a conveyance path;
an image forming device configured to form an image on the sheet-shaped medium in the conveyance path; and
a movement mechanism configured to move to a first position and a second position,
in a case the movement mechanism is in the first position, the feed roller configured to contact a first sheet-shaped medium unrolled from a roll body accommodated in the feed tray to feed the first sheet-shaped medium, and in a case the movement mechanism is in the second position, the feed roller configured to contact a second sheet-shaped medium, the feed tray configured to accommodate a plurality of second sheet-shaped media in a stacked state, wherein the movement mechanism further comprises:

a swing arm configured to rotatably support the feed roller; and a swing shaft configured to support the swing arm to be swingable.

14. The image forming apparatus according to claim 13, wherein the swing shaft is disposed below an upper end portion of the feed tray.

15. The image forming apparatus according to claim 13, further comprising:

a power transmission mechanism mounted on the swing arm, the power transmission mechanism being configured to transmit power from a drive source to the feed roller, wherein the power transmission mechanism comprises:

a transmission belt; and a gear train.

16. The image forming apparatus according to claim 15, wherein the power transmission mechanism further comprises:

a cut mechanism disposed between the transmission belt and the feed roller, the cut mechanism being configured to selectively take a first state and a second state, in a case the cut mechanism takes the first state, the power being transmitted from the drive source to the feed roller, and in a case the cut mechanism takes the second state, the power transmission being cut off.

17. The image forming apparatus according to claim 13, wherein the movement mechanism further comprises:

an urge member configured to urge the swing arm in a direction of weakening a force applied to the sheet-shaped medium from the swing arm along the up and down direction.

18. The image forming apparatus according to claim 13, wherein the swing shaft is supported by the housing, wherein the feed tray has a convex portion extending upward at an upstream end portion in a direction of removing the feed tray from the housing, and wherein the swing arm is configured to move to a retraction position when the feed tray is inserted into and removed from the housing, the retraction position being above the convex portion.

19. An image forming apparatus comprising:

a housing;

a feed roller configured to feed a sheet-shaped medium toward a conveyance path;

an image forming device configured to form an image on the sheet-shaped medium in the conveyance path; and a movement mechanism configured to move to a first position and a second position, in a case the movement mechanism is in the first position, the feed roller configured to contact a first sheet-shaped medium unrolled from a roll body to feed the first sheet-shaped medium, and in a case the movement mechanism is in the second position, the feed roller configured to contact a second sheet-shaped medium of a plurality of second sheet-shaped media accommodated in a stacked state, wherein the feed roller is disposed at an upstream side of a cut mechanism in a conveyance direction.

20. The image forming apparatus according to claim 19, wherein the first sheet-shaped medium is uncut when fed by the feed roller.

21. The image forming apparatus according to claim 19, wherein the cut mechanism is disposed downstream in a conveyance direction from a tip of the second sheet-shaped medium accommodated in a second accommodation portion.

22. The image forming apparatus according to claim 19, wherein the feed roller feeds the first sheet-shaped medium unrolled from below the roll body.

23. An image forming apparatus comprising:

a housing;

a feed roller configured to feed a sheet-shaped medium toward a conveyance path;

an image forming device configured to form an image on the sheet-shaped medium in the conveyance path; and a movement mechanism configured to move to a first position and a second position, in a case the movement mechanism is in the first position, the feed roller configured to contact a first sheet-shaped medium unrolled from a roll body to feed the first sheet-shaped medium, and in a case the movement mechanism is in the second position, the feed roller configured to contact a second sheet-shaped medium of a plurality of second sheet-shaped media accommodated in a stacked state, wherein the movement mechanism further comprises:

a swing arm configured to rotatably support the feed roller; and a swing shaft configured to support the swing arm to be swingable.

* * * * *